United States Patent [19]

Ganssle et al.

[11] Patent Number: 4,550,319

[45] Date of Patent: Oct. 29, 1985

[54] REFLECTOR ANTENNA MOUNTED IN THERMAL DISTORTION ISOLATION

[75] Inventors: Eugene R. Ganssle, Skillman; Claude P. Miller, West Deptford, both of N.J.

[73] Assignee: RCA Corporation, Princeton, N.J.

[21] Appl. No.: 421,466

[22] Filed: Sep. 22, 1982

[51] Int. Cl.[4] ..... H01Q 3/02

[52] U.S. Cl. ..... 343/882; 343/DIG. 2

[58] Field of Search ..... 343/882, 881, DIG. 2, 343/878, 892, 840, 915, 890, 765; 350/288; 244/158, 163; 248/179, 181

[56] References Cited

U.S. PATENT DOCUMENTS

| | | | |
|---|---|---|---|
| 3,215,391 | 11/1965 | Sturm | 343/883 |
| 3,374,977 | 3/1968 | Moy, Jr. | 343/765 |
| 3,898,667 | 8/1975 | Raab | 343/756 |
| 3,912,380 | 10/1975 | Klein | 350/288 |
| 4,116,263 | 9/1978 | Ganssle et al. | 165/27 |
| 4,352,113 | 9/1982 | Labruyere | 343/915 |

FOREIGN PATENT DOCUMENTS

| | | | |
|---|---|---|---|
| 0043772 | 1/1982 | European Pat. Off. | 343/882 |
| 1163088 | 9/1969 | United Kingdom | 343/882 |
| 2053577 | 2/1981 | United Kingdom | 343/DIG. 2 |

OTHER PUBLICATIONS

"Advanced Composite Structures for Satellite Systems," by R. N. Gounder, *RCA Engineer*, Jan. Feb. 1981, pp. 12–22.

*Aviation Week & Space Technology*, Jun. 7, 1982, p. 91.

"Optimized Design and Fabrication Processes for Advanced Composite Spacecraft Structures," by V. F. Mazzio et al., *17th Aerospace Sciences Meeting*, New Orleans, LA, Jan. 15–17, 1979, pp. 1–8.

"KEVLAR Aramid The Fiber that Lets You Re-Think Strength and Weight,"published by DuPont Company, pp. 3–4, 6, 8, 10, 12, 16, and 18–23.

*Primary Examiner*—Eli Lieberman

*Assistant Examiner*—Michael C. Wimer

*Attorney, Agent, or Firm*—Joseph S. Tripoli; George E. Haas; William Squire

[57] ABSTRACT

A communications spacecraft reflector is accurately positioned with respect to its feed assembly by a thermally stable stiff mounting platform which is secured in distortion isolation from the rest of the spacecraft. A yaw actuator can move the platform about an axis parallel to the spacecraft yaw axis.

12 Claims, 6 Drawing Figures

REFLECTOR ANTENNA MOUNTED IN THERMAL DISTORTION ISOLATION

The present invention relates to the construction of antennas and more particularly antennas which are useful in a communication satellite.

Antennas employed in communication satellites include an electromagnetic wave reflector and a feed assembly for the electromagnetic waves. The feed assembly is required to be located at the antenna reflector focal point. Present communication satellites employ reflectors and feed assemblies which are directly mounted to the spacecraft structure. For example, one such system is shown in U.S. Pat. No. 3,898,667 in which the antenna reflectors in overlapped relation are secured by posts to a satellite. The antenna system also includes waveguide feed horns also secured to the satellite structure by posts. Another example of a communication satellite antenna system is shown in an article in Aviation Week and Space Technology, June 7, 1982, page 91.

As the antenna system for a communication satellite becomes larger, the feed assemblies and reflectors become more widely separated because of the longer focal length of the reflectors. It is becoming more common and more necessary in state-of-the-art systems that the reflector or the feed assembly be deployed after the satellite is in an orbiting position in space, so that the spacecraft antenna can be dimensionally large when operating and yet fit in the small space of a shroud during launch. That is, the antenna and feed horn assemblies are required during launch to be stowed in a compact arrangement. After the satellite achieves its operating orbit, the feed assembly or antenna, as the case may be, may be unfolded from the stowed position to an operating position.

In the above structures the spacecraft structure is employed as the support which joins the physically separated feed assembly and reflector. The spacecraft also provides a hinge point for deployable systems. The spacecraft structures typically support attitude reference sensors which sense and measure the pointing direction of the spacecraft and hence the antenna. Up to a certain maximum spacing between the feed assembly and reflector, the prior above-described techniques are satisfactory. However, as the spacing between the feed assembly and reflector increases the antenna performance can be significantly degraded by structural distortions of the spacecraft due to solar illumination on the spacecraft which varies with the time of day and day of year.

In accordance with an embodiment of the present invention, the above degradation in antenna performance is greatly alleviated by an antenna construction in which distortions of the spacecraft structure which can corrupt the antenna geometry, that is, the spaced relationship of the feed assembly to the reflector, are minimized and the distortions of the spacecraft which affect the angular relationship between the antenna reflector and the attitude reference sensors employed to aim the antenna resulting in antenna bore sight vector error are also minimized. The embodiment of the present invention includes a thermally stable, relatively stiff member which has negligible distortion in the presence of temperature excursions. An antenna reflector is secured to the thermally stable member, the reflector having a given focus. A feed means is secured to the member at the focus for receiving or radiating electromagnetic waves incident on the reflector. Means are coupled to the member for securing the member in distortion isolation to a distortable support, for example, a spacecraft structure.

Figure 1:
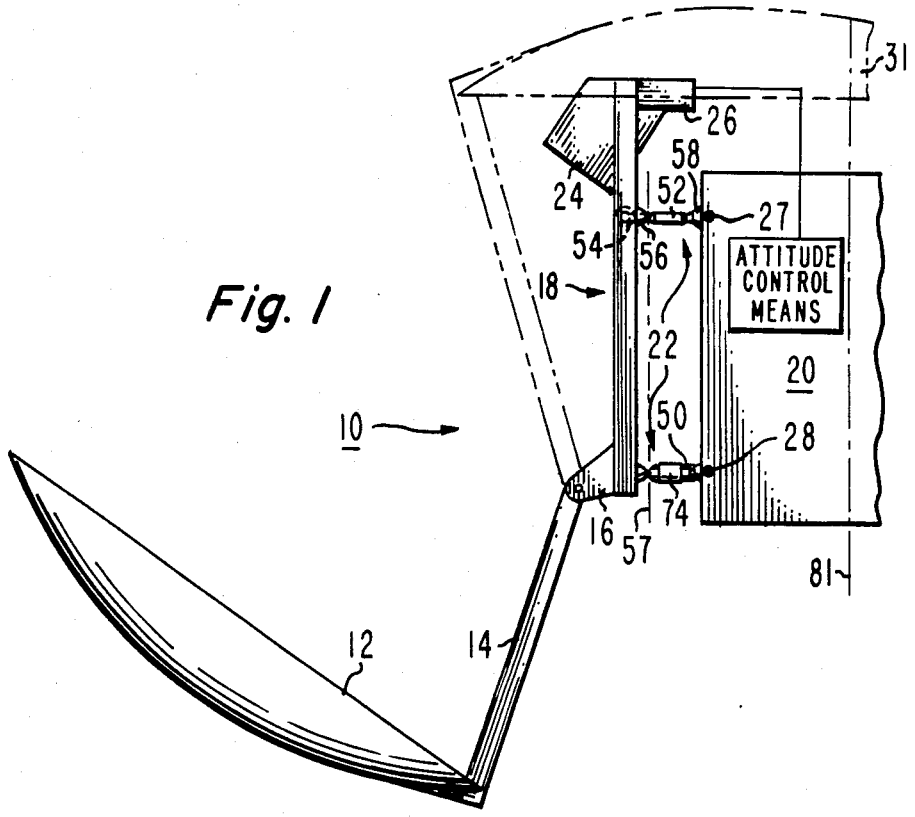
FIG. 1 is a side elevation view of a deployable antenna system in accordance with one embodiment of the present invention.

In FIG. 1 antenna system 10 comprises a parabolic reflector 12 (for reflecting electromagnetic waves) secured to an arm 14 at one end which is hinged at the opposite end via hinge assembly 16 to mounting platform 18. The reflector 12 is moved from a stowed position (broken lines) during launch to its operating position (solid lines) during orbit by means not shown. The mounting platform 18 is secured by support structure 22 in substantial distortion isolation from main spacecraft body 20. The platform 18, as will be described, is stiff, insensitive to variations in its thermal environment, and remains substantially undistorted, in the presence of distortions which may arise in the supporting main spacecraft body 20 structure. Secured to the platform 18 is a radiator or feed horn assembly 24 and an earth sensor 26.

By the term "distortion isolation" is meant that distortions which may exist in one structure, for example, in the spacecraft 20 between two or more points, for example, between points 27 and 28 at which some of the elements of the support structure 22 are located are not transferred to a second structure, for example, through the support structure 22 to the platform 18. The term "distortion" includes bending, rippling, warping or other mechanical deformation. The support structure 22 is essentially a three-point support for the platform 18 as will be described in connection with FIG. 2 later. Any distortions in the spacecraft 20 that are between those essentially three points on the platform 18 may result in the platform rotating as an integral unit but no distortions are effectively transferred to the platform in the area thereof between the locations where the support structure 22 is joined to the platform 18.

For example, the spacecraft structure 20 in the area between points 27 and 28 may distort due to the presence of increased temperature produced by sunlight incident on the various elements such as panels, beams, payload structures, and so forth, mounted on or forming the spacecraft 20. The distortion may be in the form of bending, twisting, rippling or other mechanical deformations of the spacecraft 20 between points 27 and 28 resulting from expansion or contraction of the different spacecraft elements in the presence of temperature excursions. Such distortions, per se, are not transferred to the platform 18 by the support structure 22. Instead, the differential movements of the points 27, 28, and the third point, as will be apparent from the construction to be described later, in response to such distortions may cause a rotation of the platform 18 but not mechanical deformations in the platform of the type described above. In essence, distortions of spacecraft 20 may result in a movement of one or more of the three support points at the platform 18 with respect to each other which may cause a rotation of the plane of the platform 18 from the position shown in FIG. 1. However, that rotation or movement of the platform 18, as will be described later, can be sensed by the sensor 26 and suitable controls on the spacecraft 20 operated to reorient the spacecraft and hence, the antenna 12 to correct for the rotations of the platform 18. What is undesirable is any bending, twisting, or other mechanical deformation of the antenna assembly 10 between the feed assembly 24 and the reflector 12 which would tend to misaim the reflector 12 in an unknown way and which misaiming would not be sensed by sensor 26.

The platform 18 which may be rectangular is made stiff so that it does not easily distort, that is, bend, fold, ripple, and so forth, in the presence of external induced stresses transferred to it by the support structure 22, the feed assembly 24, antenna reflector 12 or support arm 14. Orientation of the feed assembly 24 with respect to the reflector 12 is critical as known in the antenna art and their spaced relationship must remain fixed. That spaced relationship is maintained by the platform 18. Further, the platform 18 is made quasi-isotropic at least in the broad plane of the structure so that it does not distort and is made of low coefficient of expansion materials so that it does not experience relatively large expansions or contractions in the presence of thermal excursions. By securing the earth sensor 26 directly to the platform 18, the antenna reflector 12 can be accurately oriented at all times by a controller (not shown) responsive to signals from sensor 26. This controller, in response to sensor signals which sense the attitude of the antenna on platform 18, produces attitude control signals which are applied to the satellite attitude control system to correct for attitude errors. This structure thus avoids the introduction of errors produced by distortions in the main spacecraft body 20 structure whereas in the prior art the feed assembly 24 and sensor 26 are mounted directly to the main spacecraft body 20 at locations spaced from the reflector 12.

Reflector 12 may be a single or overlapped frequency reuse reflector in accordance with a given implementation. Overlapped reflectors provide a compact frequency reuse antenna and are useful in spacecraft applications where space is at a premium. Such compact frequency reuse antennas are described, for example, in U.S. Pat. No. 3,898,667 and as described in an article by H. A. Rosen entitled "The SBS Communication Satellite-an Integrated Design," 1978 IEEE CH1352-4/78/0000-0343, pp. 343–345. Reflector 12 may be constructed as described in U.S. Pat. Nos. 2,742,387 and 2,682,491 and in an article entitled "Advanced Composite Structures for Satellite Systems" by R. N. Gounder, *RCA Engineer,* Jan./Feb. 1981, pp. 12–22. Another antenna construction is described in copending application (RCA 77,648) entitled "Antenna Construction," assigned to the assignee of the present invention filed Aug. 16, 1982 Ser. No. 408,503.

Reflector 12 is secured at one end to arm 14 which may be a truss network comprising two parallel elongated beams (one being shown) interconnected by an intermediate truss (not shown). The opposite end of arm 14 is mounted to platform 18 by hinge assembly 16. The hinge assembly 16 may comprise two hinges (only one being shown) each connected to a separate different one of the beams forming the arm 14. The hinge assemblies 16 are secured to the platform 18.

Figure 6:
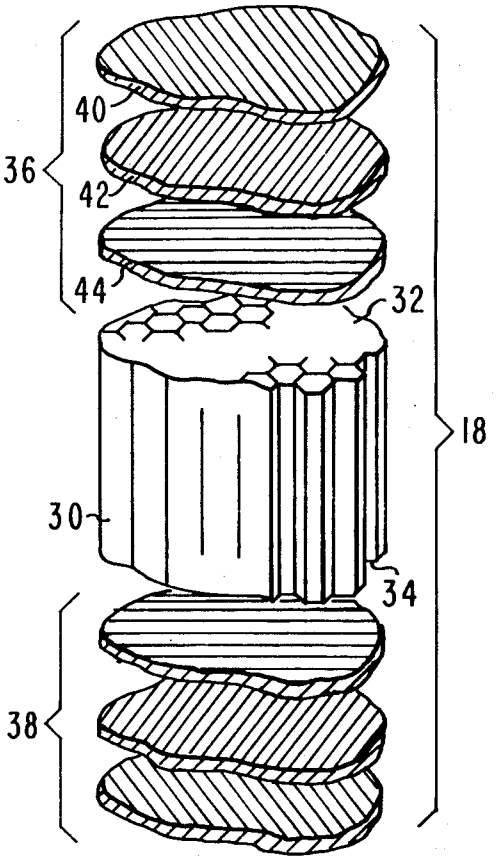
FIG. 6 is an exploded isometric view of the structural elements forming the support platform of the embodiment of FIG. 1.

Platform 18 is made of composite materials, as will be described, is thermally stable, is relatively stiff, and has negligible distortion in the presence of temperature excursions. By thermally stable is meant the platform has negligible expansions and contractions in the presence of temperature excursions. The platform 18 comprises a sandwich construction as shown in FIG. 6. In FIG. 6 platform 18 comprises a honeycomb aluminum core 30 formed of honeycomb hexagonal cells made of undulating aluminum ribbons interconnected in a cellular construction. Core 30 has parallel opposite broad flat faces 32 and 34. Face skin 36 is adhesively bonded to face 32 and an identical face skin 38 is bonded to face 34. Face skin 36 comprises three plies 40, 42, 44 (or multi-three ply layers) of unidirectional carbon epoxy-reinforced fabrics. The parallel lines in FIG. 6 of each of the plies 40, 42, and 44 indicate the direction of the fibers of each ply. The orientation of the plies are such that the plies in combination with the core 30 form a quasi-isotropic structure which has a coefficient of expansion close to zero. The plies 40, 42, 44, for example, to achieve such a coefficient of expansion may have an orientation of [0°±60°], or four plies may be used in an orientation of [0°/±45°/90°]. The former orientation is illustrated in FIG. 6.

Assuming, for example, that the ply 44 orientation is 0° as a reference, then the orientation of the fibers of ply 42 is +60° and that of ply 40 is −60°. The orientation of the plies of skin 38 is a mirror image of the orientation of the plies of skin 36. In both cases the ply with the 0° orientation is bonded directly to the face of core 30. The resultant structure has a coefficient of expansion close to zero and thus has a minimum distortion in the presence of temperature changes. The platform is referred to as having quasi-isotropic properties in that it is recognized that perfect isotropic properties are relatively difficult to achieve because of normal variations in material properties. An isotropic structure is most desirable.

The stability of the skins 36 and 38 is enhanced by the aluminum core 30 whose relatively high thermal conductivity minimizes the temperature gradient through the composite structure. Even greater uniformity of temperature distribution throughout the structure can be achieved by enclosing the platform 18 in multi-layer insulation blankets (not shown). The resulting platform structure provides support for all of the elements described above secured thereto whose spaced relationships must be preserved and which itself is substantially insensitive to thermal variations.

By making the platform 18 thermally stable and relatively stiff, the spaced relationship of the feed assembly 24, FIG. 1, to the reflector 12 and to the earth sensor 26 are maintained regardless of the thermal variations in the environment of the structures. By "stiff" is meant that the platform 18 exhibits negligible mechanical displacement between the elements comprising the hinge assembly 16, feed assembly 24, earth sensor 26, and the support structure 22.

The displacement of one element with respect to the other (for example, 12 and 24) is undesirable and is to be avoided. The platform 18 as described in connection with FIG. 6 preserves that spaced relationship of the various elements. However, the platform 18 must also be insensitive to distortions of the main spacecraft body 20. Any distortions of the main spacecraft body 20 which are transferred to the platform 18 will defeat the purpose of maintaining the various elements of the antenna system 10 in their desired spaced relationship.

To secure the platform 18 in distortion isolation from the main spacecraft body 20 the platform is secured at essentially three points to the main spacecraft body 20. (The points of mounting the structure 22 act effectively as three points on the platform 18 but which, in effect, may be more than three points as will be shown later in connection with FIG. 2). By connecting the platform to effectively three points, any movement of the spacecraft 20 with respect to these points will result in a rotation or movement of a plane—the three points defining such a plane. Further, the mounting structure 22 which secures the platform 18 to main spacecraft body 20 avoids redundancy at the points at which the structure 22 is secured to the platform 18. By redundancy is meant duplication of function. In this case the elements of structure 22 are each required and none duplicate the function of the other. Thus, changes in temperature which may cause relative dimensional changes between the platform and spacecraft structure do not induce undesirable distortions in the platform 18.

Figure 2:
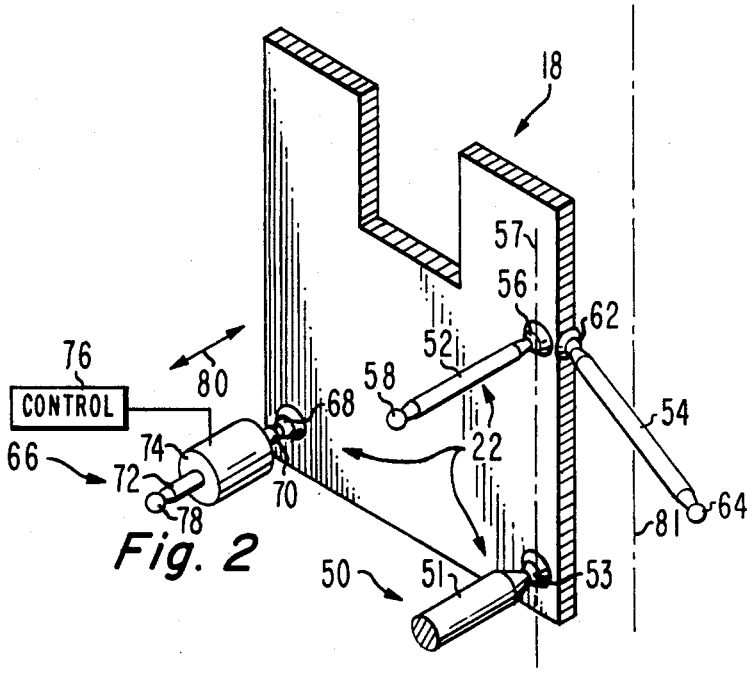
FIG. 2 is an isometric view of the support platform employed in the embodiment of FIG. 1.

In FIG. 2 the support structure 22 comprises a ball joint assembly 50 which connects the platform 18 to the spacecraft 20. Assembly 50 includes a support arm 51 and a ball joint 53 fixed at one end. The ball joint is fixed to the platform 18 with the socket fixed to the platform and the ball fixed to one end of support arm 51. The opposite end of the support arm 51 is connected to the main spacecraft body 20. Support arm 51 may be a cylindrical post which absorbs anticipated loads in all directions without distortion or bending. The ball joint 53 permits rotation of the platform 18 with respect to the spacecraft 20 about the center of the ball of the joint. However, the ball joint 53 prevents linear motions of the platform 18 with respect to the main spacecraft body 20 in any of the three orthogonal linear directions. For example, in FIG. 3 the assembly 50, ball joint 53 prevents linear displacement of the main spacecraft body 20, FIG. 1, with respect to the platform 18 in the X and Z directions through ball joint 53 which directions are in the plane of the drawing and in the Y direction through the joint 53 which is perpendicular to the plane of the drawing. Thus, the platform 18 is able to pivot with respect to the main spacecraft body 20 about the center of the ball joint 53 but cannot displace in any of the directions X, Y, or Z at that location.

The structure 22 also includes two rods 52 and 54 whose length dimensions lie in the same plane which is perpendicular to platform 18. Rod 54 length dimension extends at an acute angle with the platform 18. The angle of rod 54 to the plane platform 18 is made sufficiently small so that the rod 54 length dimension longest component is in directions 60, FIG. 3, and its smallest component in the Y direction. Rod 54 is so oriented to provide maximum resistance to displacement of platform 18 in directions 60. One end of the rod 54 is connected with a ball joint 62 to a narrow side or edge of platform 18 and the other end of the rod 54 is connected by ball joint 64 to the main spacecraft body 20 (FIG. 1).

The rod 52 is connected between platform 18 and the main spacecraft body via ball joints 56 and 58. Rod 52 resists displacement of the platform 18 with respect to the main spacecraft body 20 in the Y direction, FIG. 3. Any forces tending to displace the platform 18 with respect to the main spacecraft body 20 in any other direction is minimally resisted by the rod 52 which would tend to permit such displacement. Ball joint 56 connects one end of rod 52 to the broad face of platform 18 close to ball joint 62. Rod 52 is perpendicular to the plane of the broad surface of platform 18 and in FIG. 3 its length dimension is in the Y direction represented by black dot 52'. The plane in which rods 52 and 54 lie is perpendicular to axis 57 through the center of rotation of the ball joints 53 and 56. Axis 57 is relatively close to platform 18.

Figure 3:
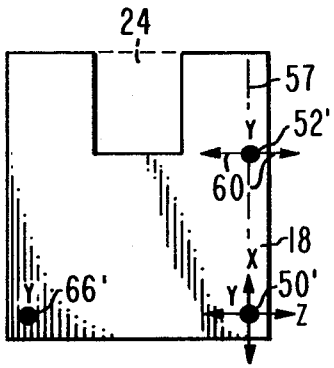
FIG. 3 is a plan view of the support platform of the embodiment of FIG. 2 illustrating a load diagram for the support struts.

Thus, the resistance to Y direction forces, FIG. 3, is provided by rod 52 and assembly 50. Rod 54 provides significant stiffness between the platform 18 and the main spacecraft body 20 in the directions 60, FIG. 3. That is, rod 54, because it is at a relatively small angle to the plane of platform 18, has substantial resistance to forces in other directions 60. Rod 54 has minimal resistance to forces in other directions significantly different than directions parallel to its length. The ball joints 56 and 62, FIG. 2, are effectively connected to the same point for reasons as will be explained.

Rod assembly 66, FIG. 2, is connected by ball joint 68 to a third point on the platform 18. The assembly 66 comprises two aligned rods 70 and 72 joined by an actuator 74 which is operated by control 76 mounted on the main spacecraft body 10 (not shown in this figure). Rod 72 is connected to the spacecraft 20 by ball joint 78. Rod 70 is connected to platform 18 via ball joint 68. Assembly 66 extends parallel to the rod 52 and resists displacement of platform 18 with respect to the main spacecraft body 20 in the Y directions perpendicular to platform 18. The assembly 66 is represented by the black dot 66', FIG. 3.

As shown by FIG. 3, the connections of the various elements of the support structure 22, FIG. 2, are effectively at three spaced points on platform 18 at the vertices of a triangle. As well known, displacement of any one point of a triangle in a direction normal to its plane causes the plane defined by those three points to rotate about the other points. Therefore, any distortions in the main spacecraft body 20 to which any of the structure 22 elements are connected will result in a displacement of any of those elements (rods 52, 54 or assembly 66) in any direction and will result in a net displacement of the platform 18 with respect to the main spacecraft body 20 and therefore a rotation of the platform 18 and not in a transfer of distortions to or change in length of the platform 18.

The control 76 and actuator 74, FIG. 2, serve an additional important function. Actuator 74 elongates the assembly 66 in directions 80 parallel to rod 52. This causes rotation of the platform 18 about axis 57 which is parallel to the spacecraft yaw axis 81 (see FIG. 1). The yaw axis in communication satellites generally points to earth. This ability to control rotation about the yaw axis is important with respect to a spacecraft whose orbital station longitude might have to be changed in orbit or whose time zone of coverage (the antenna reflector 12 view of earth) might be changed in orbit. Adjustment of the two spacecraft axes (roll and pitch) is accomplished by tilting the spacecraft momentum wheel axis (roll) and by adjusting the spacecraft momentum wheel speed (pitch). However, it is relatively difficult to adjust the third axis (yaw) with spacecraft equipment.

The antenna system supported as shown in FIG. 2 readily lends itself to such an adjustment. The yaw actuator 74 is an integral part of the rods 70 and 72 and they are effective as a single extendable rod. The demand for a yaw angle change via the control 76 causes a motor in the actuator 74, which may include a ball screw mechanism, to change its length between rods 70 and 72. A ball screw mechanism is one in which a screw rotated by a motor is threaded to a nut. The nut is locked to prevent its rotation. Rotation of the screw thus displaces the nut along the length of the screw. The rod 70 may, for example, be attached to such a nut. The change in spacing between joints 68 and 78 produces an appropriate rotation of the platform 18 about axis 57. The position of the platform 18 and its orientation is sensed by the sensor 26, FIG. 1, and the sensor signals representing antenna orientation are applied to control electronics (not shown) on the main spacecraft body 20. Prior sensors such as sensor 26 have been secured directly to the main spacecraft body rather than to the isolated antenna mounting platform as shown in FIG. 1. Thus the sensed orientation of the sensor 26 directly determines the orientation of the antenna reflector 12 and feed assembly 24 rather than indirectly by sensing the orientation of the spacecraft.

In rotating platform 18 about axis 57, FIG. 2, it is recognized that in practicality, joint 62 is spaced a relatively small distance from joint 56. Thus, an attempt to rotate platform 18 about axis 57 may, in some cases, tend to foreshorten or lengthen rod 54. This is not possible because of the relative rigidity of rod 54. In this case platform 18 would tend to move slightly in other directions. Since it is contemplated, by way of example, that acuatator 74 move platform 18 about axis 57 in the order of a few degrees, the actual displacement of platform 18 in these other directions, by way of example, may be in the order of a few thousandths of an inch. In any case, if the latter is undesirable, the joint 62 in the alternative, may be made concentric with joint 56 so that both rods 52 and 54 rotate about the same central pivot point. For example, joint 62 may be replaced with a spherical sleeve which slips over the ball of joint 56 so that ball serves as a bearing for rods 52 and 54.

Figure 4:
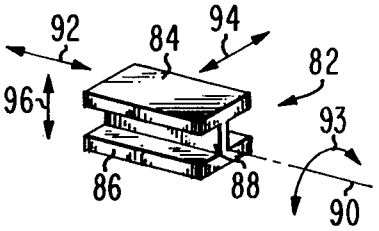
FIG. 4 is an isometric view of an alternate support employed in place of the struts of FIG. 2.
Figure 5:
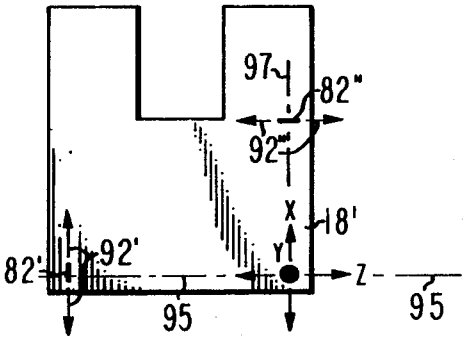
FIG. 5 is a plan view of the support platform and load diagram employing the structure of FIG. 4.

In the alternative, a flexible mount structure may be employed in place of the rods of FIG. 2, as shown in FIGS. 4 and 5. In FIG. 4 a flex mount element 82 comprises an I beam having two flanges 84 and 86 connected by a relatively thin upstanding beam web 88. Element 82 may be made of high strength steel, however, other materials may be used depending upon a given implementation. In this structure the flexibility of the beam web 88 allows the flanges 84 and 86 to rotate relative to each other and to be displaced in directions 94 relative to each other. The beam web 88 prevents the flange 84 from displacing in the Y directions 96, the directions 92 and 94 being normal to each other and to directions 96.

In FIG. 5 a flex mount 82 is mounted at 82' and a second flex mount 82 is mounted at 82''. The flex mount element at 82' is mounted with its beam web 88 parallel to directions 92' corresponding to direction 92, FIG. 4. Directions 92' are perpendicular to a line, (broken line 95) passing through the element 82 at 82' and the center of the ball joint 53 as represented by the Y axis, FIG. 5 (black dot). The flex mount element at 82'' is mounted with its beam web 88 (corresponding to directions 92 of element 82) parallel to directions 92''. Directions 92'' is perpendicular to a line (broken line 97) passing through the center of the ball joint 53 as represented by the Y axis, FIG. 5. Lines 95 and 97 are perpendicular to each other. Line 97 is parallel to axis 57, FIG. 2.

As a result, the platform 18', FIG. 5, cannot linearly displace in any direction with respect to the spacecraft 20 to which the flex mount elements 82 at 82' and 82'' are connected. Expansion of the main spacecraft body, for example, which puts expansion stress between the points at 82'' and the ball joint at the Y axis would result in flexure of the web 88, FIG. 4. The same would occur with respect to the flex mount element 82'. Thus, the structure shown in FIG. 5 permits any dimensional changes in the spacecraft body to occur without inducing stresses or distortions into the platform 18'.

While particular materials and construction have been given for the reflector 12 and for the platform 18, it will be apparent that other materials and construction may be employed in the alternative. What is desired is that these structures perform their intended functions as described above. In essence, the platform 18, as described, is a thermally stable, relatively stiff member which has negligible distortion in the presence of temperature excursions. Structure 22 secures the platform 18 to a support such as a spacecraft 20 in distortion isolation.

What is claimed is:

1. A system for mounting an antenna including a reflector and feed means to a support structure such that distortions in the support structure due to temperature excursions do not degrade antenna performance comprising:

a thermally stable, relatively stiff support member which has negligible distortion in the presence of said temperature excursion;

said reflector and said feed means secured to said member with said feed means located at the focus of said reflector; and means coupled to said member for securing said member in distortion isolation to said support structure such that said member tilts as a unit relative to said support structure rather than distorts in response to distortion in said support structure, said means for securing including means for securing said member to said support structure at effectively three spaced locations, said means for securing including at (1) the first of said locations ball joint means for permitting relative rotation of said member to said structure in response to said distortion and for resisting displacement of said member relative to said support structure in any of three orthogonal directions, (2) at the second location means for resisting displacement of said member relative to said support structure in one of said three orthogonal directions normal to said member and for permitting relative displacement of said member in at least one of the other two orthogonal directions in response to said distortion, and (3) at the third location means for resisting displacement of said member relative to said support structure in the one direction and in a direction normal to the one direction and to a line through the first and third locations and permitting relative displacement of the member in the third orthogonal direction in response to said distortion.

2. The system of claim 1 including attitude sensor means secured to said member for sensing the direction in which the reflector is aimed.

3. The system of claim 1 wherein said member comprises a plane structure formed with a honeycomb core having first and second faces and a reinforcing skin layer adherently secured to each of said faces.

4. The system of claim 3 wherein said core comprises aluminum ribbon material and said skin layer comprises a plurality of plies of carbon fiber epoxy-reinforced fabric having a combined coefficient of thermal expansion close to zero.

5. The system of claim 1 wherein said reflector includes boom means fixedly secured to the reflector and pivotally secured to the member for permitting the reflector to be moved from a stowed position to an operating position.

6. The combination of claim 1 wherein said means for securing includes a set of rods secured with ball joints to said member and said support at said second and third locations and a ball joint securing said member to one end of a rod rigidly secured at its other end to said support at the first location.

7. The construction of claim 6 wherein one of said rods includes actuator means for changing the length of that rod.

8. The combination of claim 2 wherein said support structure is the main body of a spacecraft, said antenna is a spacecraft antenna, and said spacecraft is of the type that includes attitude control means for changing the attitude of the satellite to correct for attitude errors of said reflector caused by tilting of said member.

9. An antenna construction comprising:

a plane member comprising a honeycomb core having opposite parallel faces and a face skin on each face formed into a relatively stiff sheet, said member including materials forming said member with quasi-isotropic properties;

an antenna having a paraboloid reflector with a given focus for reflecting electromagnetic waves, said reflector being secured to the plane member, and electromagnetic wave means secured to the member and located at said focus for radiating waves to or receiving waves reflected from said reflector;

a spacecraft; and means for securing said plane member to said spacecraft at at least effectively three spaced locations on said member so that said member tilts in response to distortion of said spacecraft between any of said locations, said means for securing including at (1) the first of said locations ball joint means for permitting relative rotation of said member to said spacecraft in response to said distortion and for resisting displacement of said member relative to said spacecraft in any of three orthogonal directions, (2) at the second location means for resisting displacement of said member relative to said spacecraft in one of said three orthogonal directions normal to said member and for permitting relative displacement of said member in at least one of the other two orthogonal directions in response to said distortion, and (3) at the third location means for resisting displacement of said member relative to said spacecraft in the one direction and in a direction normal to the one direction and to a line through the first and third locations and permitting relative displacement of the member in the third orthogonal direction in response to said distortion.

10. The construction of claim 9 wherein said construction includes a support beam secured to the reflector and hinged to said plane member for rotatably securing said reflector to said plane member.

11. The construction of claim 9 wherein said means for securing said plane member includes a ball joint at one location on said member and two like-spaced flexible members, each at a different location on said member, each rotatable about a corresponding axis, said corresponding axis being normal to a line through said ball joint pivot axis and the corresponding flexible member.

12. The combination of claim 11 wherein said flexible members each having a central upright member and lower and upper transverse flanges.

* * * * *